US007584955B2

(12) United States Patent
Shiohara

(10) Patent No.: US 7,584,955 B2
(45) Date of Patent: Sep. 8, 2009

(54) IMAGE FORMING DEVICE

(75) Inventor: Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 302 days.

(21) Appl. No.: 11/669,148

(22) Filed: Jan. 30, 2007

(65) Prior Publication Data

US 2007/0176354 A1 Aug. 2, 2007

(30) Foreign Application Priority Data

Jan. 31, 2006 (JP) ..... 2006-023235

(51) Int. Cl.
*B65H 1/00* (2006.01)

(52) U.S. Cl. ..... 271/162; 399/393

(58) Field of Classification Search ..... 271/162, 271/163, 164; 399/107, 393; D18/36, 40, D18/44

See application file for complete search history.

(56) References Cited

U.S. PATENT DOCUMENTS 5,100,123 A * 3/1992 Kagiura et al. ..... 271/164
D334,768 S * 4/1993 Katada et al. ..... D18/36
5,313,257 A * 5/1994 Kashima et al. ..... 399/393
D350,765 S * 9/1994 Hiroki et al. ..... D18/36
6,015,148 A * 1/2000 Cho ..... 271/164
2006/0202406 A1* 9/2006 Kobayashi ..... 271/162

FOREIGN PATENT DOCUMENTS

JP S58-069641 A 4/1983
JP H09-002673 A 1/1997

* cited by examiner

*Primary Examiner*—David H Bollinger
(74) *Attorney, Agent, or Firm*—Baker Botts L.L.P.

(57) ABSTRACT

An image forming device includes: a housing; and a sheet feeding cassette that stores a stack of sheets. The housing includes: a cassette accommodation portion that is provided at a lower part of the housing; an insertion slot from which the sheet feeding cassette is detachably inserted in the cassette accommodation portion in an insertion direction; a first support portion that is formed on a bottom part of the housing on a side near to the insertion slot; a second support portion that is formed on the bottom part of the housing on a side remote from the insertion slot; and an opening that is formed between the first support portion and the second support potion to expose the bottom face. The sheet feeding cassette includes a roller that is disposed at the bottom face of the sheet feeding cassette at a downstream side end in the insertion direction.

12 Claims, 14 Drawing Sheets

IMAGE FORMING DEVICE

CROSS-REFERENCE TO RELATED APPLICATION

This application claims priority from Japanese Patent Application No. 2006-023235, filed on Jan. 31, 2006, the entire subject matter of which is incorporated herein by reference.

TECHNICAL FIELD

Aspects of the present invention relate to an image forming device for forming an image on a sheet, such as a copying machine, a facsimile machine, a printer, and a multi-function device having a plurality of functions for serving as those machines, the image forming device being provided with a sheet feeding cassette that accommodates a plurality of sheets to be fed for forming the image thereon.

BACKGROUND

A conventional image forming device is configured to have a sheet feeding cassette being arranged in a housing (main body case) below an image forming unit that forms an image on the sheet. The sheet feeding cassette is configured to be detachable from an insertion slot that is formed on a front face of the housing. A plurality of sheets, such as cut sheets having a predetermined size, are stacked and stored in the sheet feeding cassette that is accommodated in an accommodation portion that is provided in the housing. The image forming device is also provided with a sheet feeding mechanism, such as a sheet feeding roller, which separates one sheet from the stacked sheets and feeds the sheet to the image forming unit.

Examples of the conventional image forming device are disclosed in JP-B-02-001048 and in JP-A-09-002673.

As described in the above documents, the housing of the conventional image forming device is provided with a bottom plate that is disposed over an entire bottom face of the housing for supporting a bottom face of the sheet feeding cassette. Due to this configuration, the sheet feeding cassette is reliably supported from a bottom thereof by the bottom plate, while the bottom plate maintains a rigidity of the housing.

However, in a case where the entire housing is formed by injection-molding a synthetic resin, the total quantity of the synthetic resin to be used increases to raise the cost, due to the configuration in which the bottom plate is disposed at the entire bottom of the housing. The weight of the entire image forming device also increases in this case.

In a case where the bottom plate of the housing is totally eliminated, the bottom face of the sheet feeding cassette, which is to be accommodated in the housing, is placed directly on an installation surface, such as a desktop, on which the image forming device is installed. In this case, reference positions, such as a reference height of the sheet feeding cassette to be set in the housing, becomes uncertain according to the condition of the installation surface. Also in this case, the installation surface may be deteriorated by being scratched or scraped by the bottom face of the sheet feeding cassette when the sheet feeding cassette is inserted and extracted to and from the housing.

SUMMARY

According to an aspect of the present invention, there is provided an image forming device including: a housing; and a sheet feeding cassette that stores a stack of sheets. The housing includes: a cassette accommodation portion that is provided at a lower part of the housing to accommodate the sheet feeding cassette; an insertion slot from which the sheet feeding cassette is detachably inserted into the cassette accommodation portion in an insertion direction that is substantially horizontal; a first support portion that is formed on a bottom part of the housing on a side near to the insertion slot to support a bottom face of the sheet feeding cassette; a second support portion that is formed on the bottom part of the housing on a side remote from the insertion slot to support the bottom face of the sheet feeding cassette; and an opening that is formed between the first support portion and the second support portion to expose the bottom face of the sheet feeding cassette. The sheet feeding cassette includes a roller that is disposed at the bottom face of the sheet feeding cassette, at a downstream side end in the insertion direction of the sheet feeding cassette.

DESCRIPTION

Hereinafter, examples of the present invention will be described with reference to the drawings.

Figure 1:
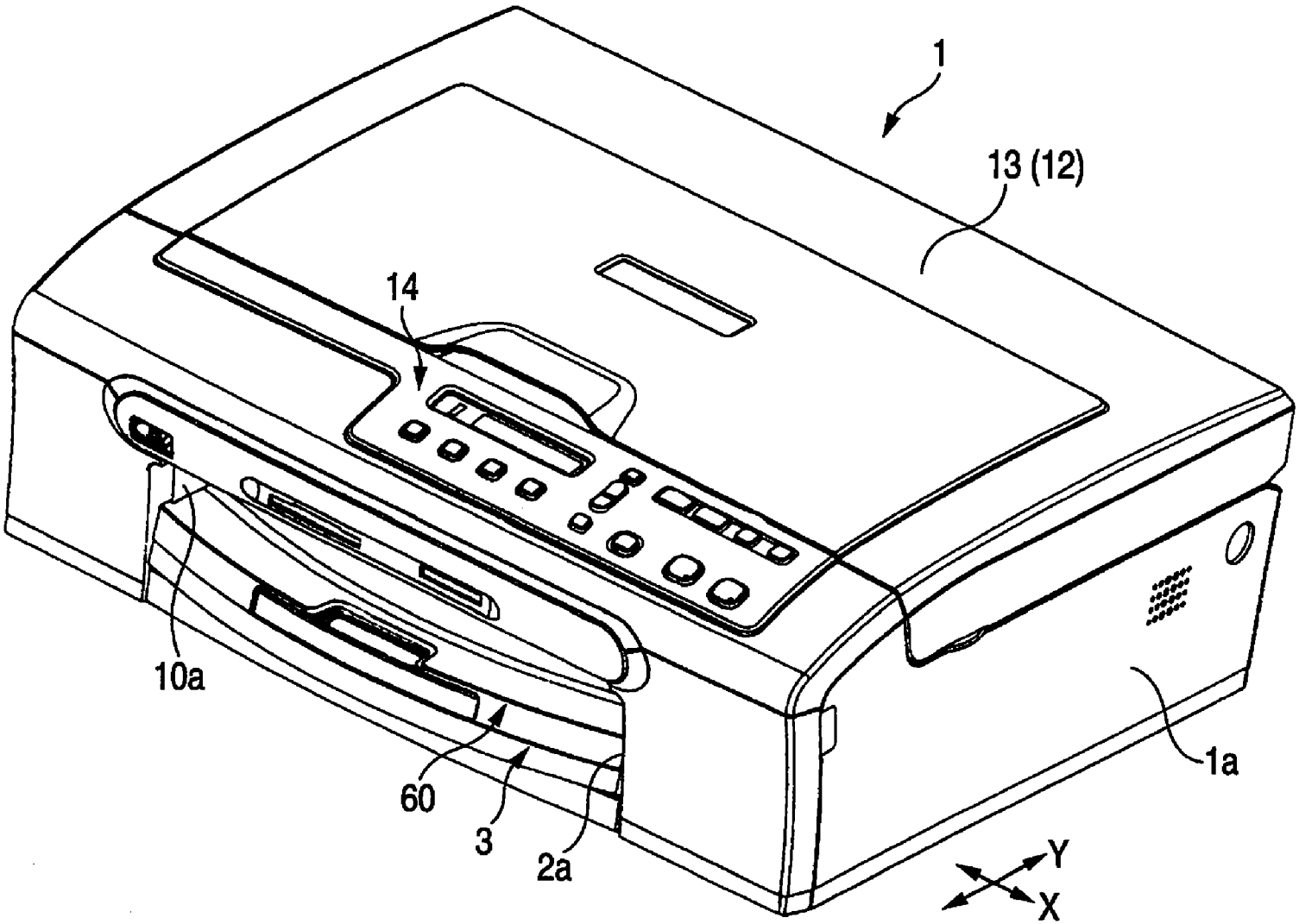
FIG. 1 is a perspective view of an appearance of an image forming device according to an example of the present invention.
Figure 4:
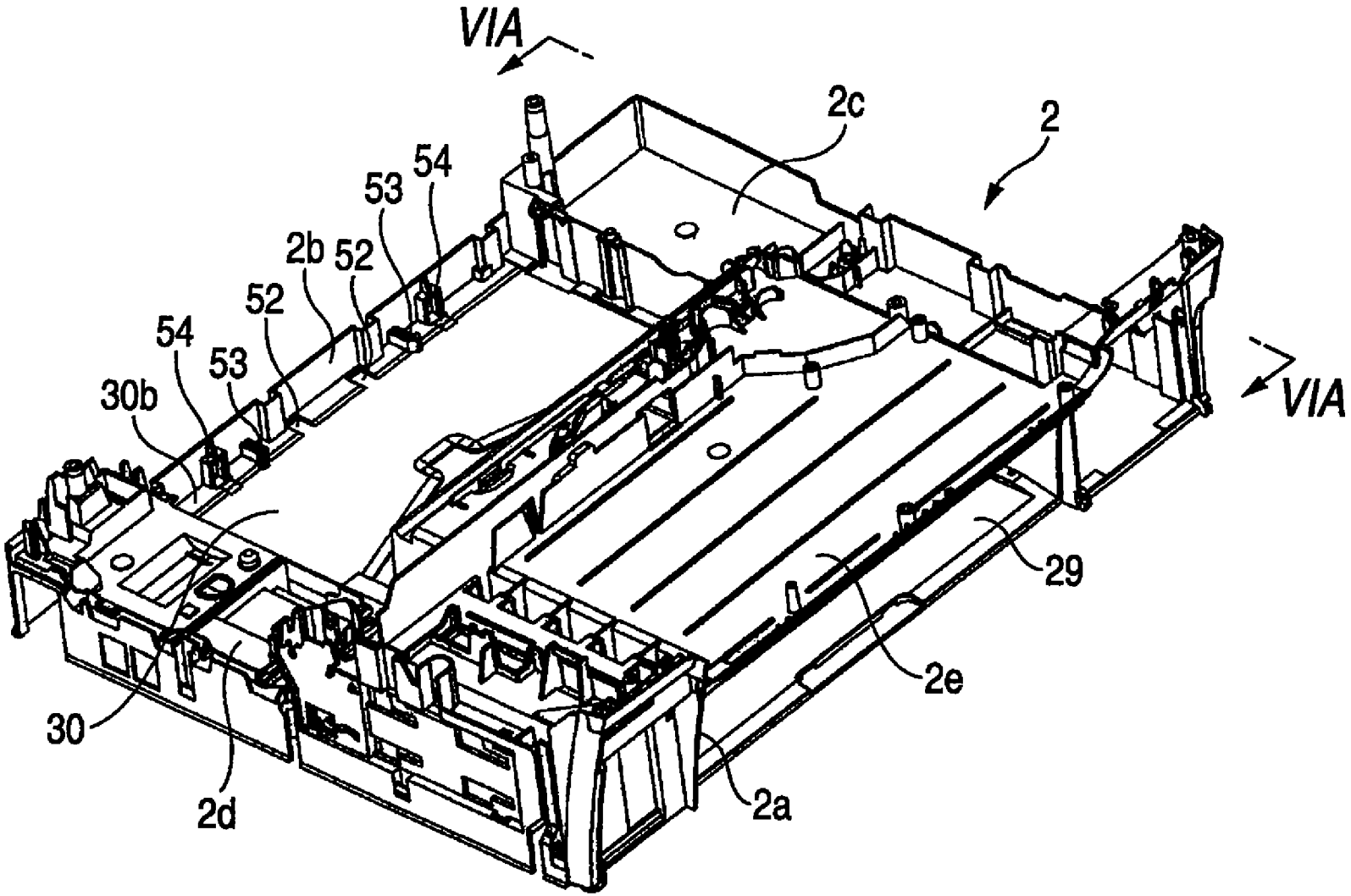
FIG. 4 is a perspective view of a housing of the image forming device.

The image forming device 1 as described herein is an example in which the present invention is applied to a multi-function device (MFD) that is provided with a printer function, a copy function, a scanner function, and a facsimile function. As shown in FIGS. 1 and 4, the image forming device 1 is provided with: a casing 1*a* that is made of a synthetic resin; and a housing 2 (as referred to FIG. 4) that is also made of a synthetic resin and is disposed in the casing 1*a*.

The image forming device 1 is also provided with a sheet feeding cassette 3 that is disposed in a cassette accommodation portion that is provided at a bottom section of the housing 2). The sheet feeding cassette 3 is configured to be detachable from the housing 2 so as to be inserted and extracted to and from the housing 2 in a substantially horizontal direction through an insertion slot 2*a* that is opened at a front face of the housing 2.

In the description herein, a side of the image forming device 1 where the insertion slot 2*a* is located in the housing 2 is called front side, or simply, front. Backside, left side, and right side of the image forming device 1 are defined with respect to the front side.

The sheet feeding cassette 3 stores a plurality of sheets that are stacked one another. The stacked sheets are positioned in the sheet feeding cassette 3 to have a narrow side thereof being aligned in a primary scanning direction (X direction in FIG. 1) that is perpendicular to a sheet conveying direction (secondary scanning direction, or Y direction in FIG. 1). The sheet P, which is one of the stacked sheets, is a cut sheet having a predetermined size, such as A4-size, letter-size, legal-size, and postcard-size.

Figure 8:
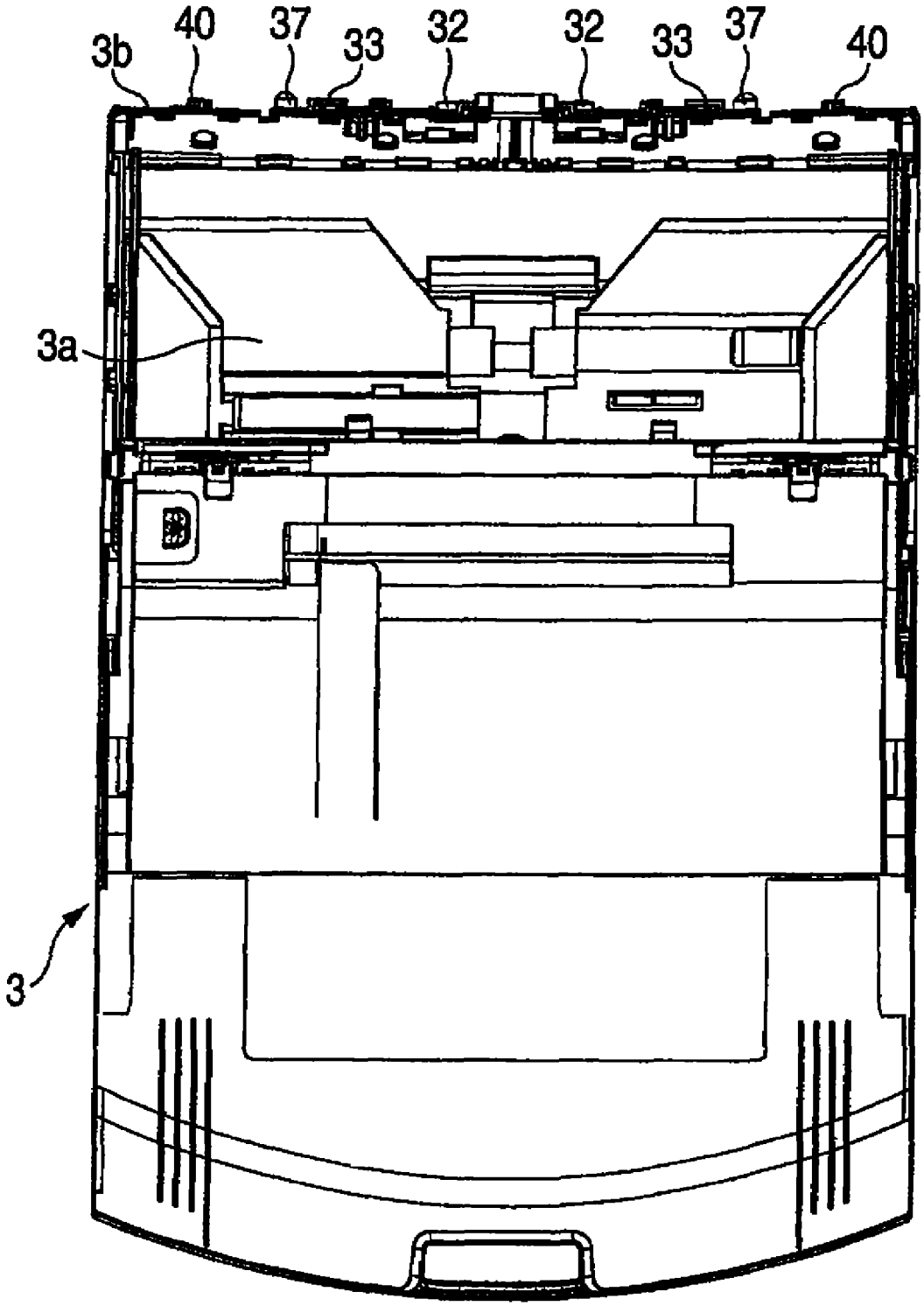
FIG. 8 is a perspective top plan view of a sheet feeding cassette of the image forming device.

An auxiliary cassette 60 is mounted above the sheet feeding cassette 3 to be displaceable in the secondary scanning direction. The auxiliary cassette 60 feeds sheets (not shown in FIG. 1) that are stacked thereon, the sheets having a small size. FIG. 1 shows a state where the auxiliary cassette 60 is pulled out near to the insertion slot 2*a* of the housing 2 while no sheets are stacked thereon. The auxiliary cassette 60 is omitted in the top plan view of FIG. 8.

A sloped separating plate 8, which separates the stacked sheets into a single sheet P, is disposed at the backside (on the right side in FIG. 3) of the sheet feeding cassette 3. An arm 6*a* is attached to the housing 2 to be rotatable at an upper end of the arm 6*a*, so as to be swingable in a vertical direction at a lower end of the arm 6*a*. A sheet feeding roller 6, which is disposed at the lower end of the arm 6*a*, and the sloped separating plate 8 cooperatively operate to separate and feed the sheet P one by one from the stacked sheets that is placed on the sheet feeding cassette 3 or on the auxiliary cassette 60. The sheet P thus separated is conveyed along a sheet conveying path 9 to an image forming unit 7 that is disposed on an upper part (higher position) at the backside of the sheet feeding cassette 3. The sheet conveying path 9 is configured to have a substantially U-lettered shape when viewed from a side of the image forming device 1. The image forming unit 7 is provided with a carriage 5 that moves back and forth and carries a print head 4 of an ink-jet type for forming an image on the conveyed sheet P.

A sheet discharging section 10 is defined above the auxiliary cassette 60. A discharge port 10*a* (above the insertion slot 2*a*, as referred to FIG. 1) is opened to the front face of the housing 2 so as to communicate with the sheet discharging section 10. The sheet P having been printed by the image forming unit 7 is discharged to the sheet discharging section 10 with a printed face being directed upward.

An image scanning unit 12 is arranged in the upper portion of the housing 2. The image scanning unit 12 scans a document when performing the copy function or the facsimile function.

An operation panel unit 14 is mounted above the housing 2 at a position before the image scanning unit 12. The operation panel unit 14 is provided with various operation buttons and a liquid crystal display unit. The image forming unit 7, the sheet discharging section 10, and an ink storage section 15 are disposed in a projected top plan area of the image forming unit 12 and the operation panel unit 14. The ink storage section 15 is disposed on one side of the sheet discharging section 10.

On the upper face of the image forming unit 12, there is disposed a platen glass (although not shown), on which the document to be scanned is placed while a cover 13 is opened. Below the image forming unit 12, an image scanner unit (CIS: Contact Image Sensor) (although not shown) is disposed to be movable back and forth in a direction perpendicular to the drawing sheet of FIG. 3 (i.e., the primary scanning direction).

Figure 3:
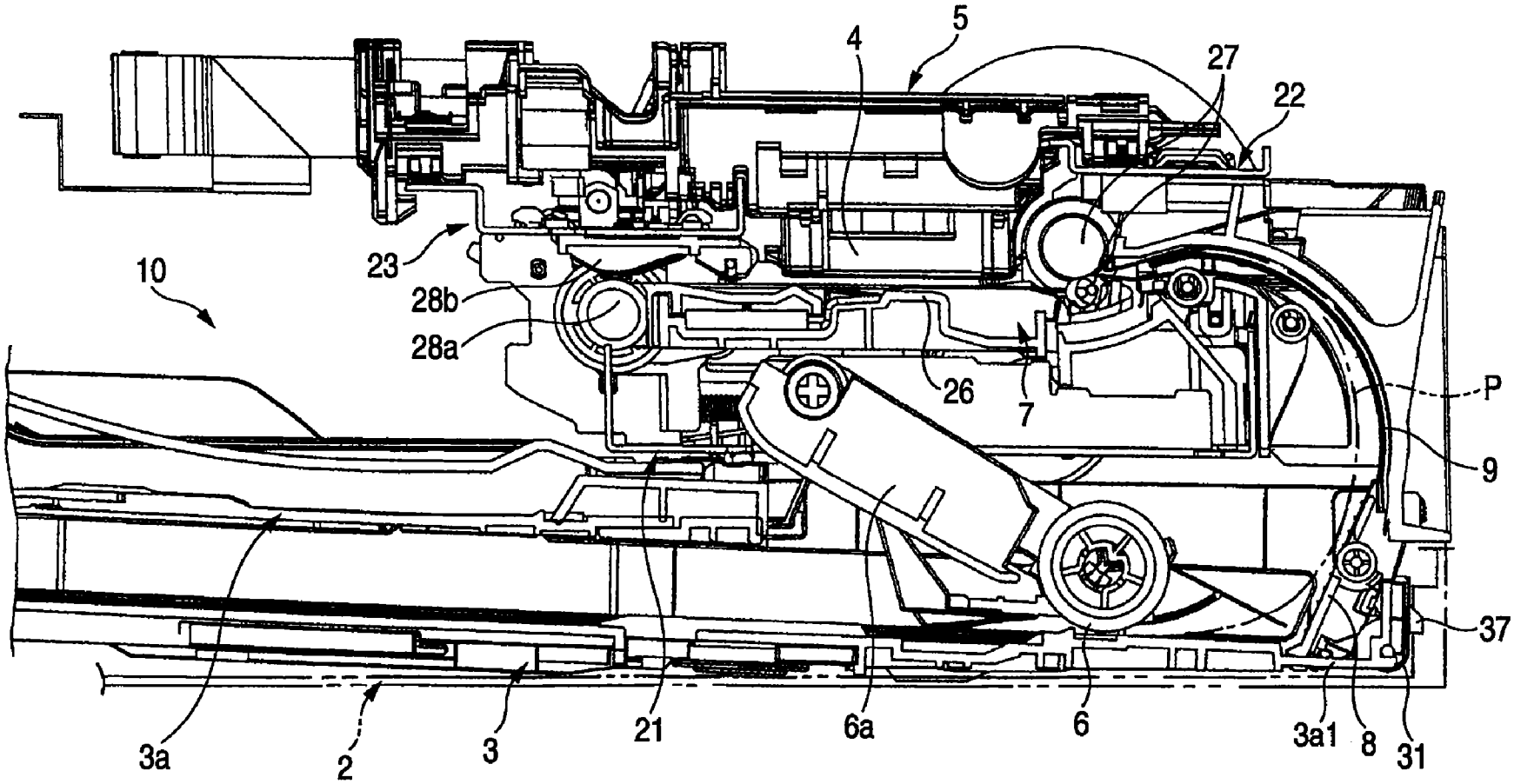
FIG. 3 is an enlarged sectional view taken along line III-III shown in FIG. 2.

The ink storage section 15 is opened upward and accommodates ink cartridges 19 (i.e., ink cartridges 19*a* to 19*d* for black (BK), cyan (C), magenta (M) and yellow (Y) inks, as referred to FIG. 3), which contain four color inks individually for printing (forming image) in full-color, and which are formed into a substantially box shape having a small area in top plan view and a comparatively larger height. The ink cartridges 19*a* to 19*d* are detachably stored in the ink storage section 15 to be detachable from upper side of the ink storage section 15, and to be arranged in one row in the secondary scanning direction.

The ink storage section 15 supplies the inks from the respective ink cartridges 19 (as individually indicated by reference numerals 19*a* to 19*d*) to the ink-jet type print head 4 through a plurality of (four in the present example) ink supplying tubes (or ink tubes) 20. In a case where ink colors more than four are used (e.g., six to eight), the configuration may be made such that the ink cartridges of the number matching the ink colors can be accommodated in the ink storage section 15, and the number of the ink supplying tubes 20 may also be increased to match the number of the ink cartridges.

Figure 2:
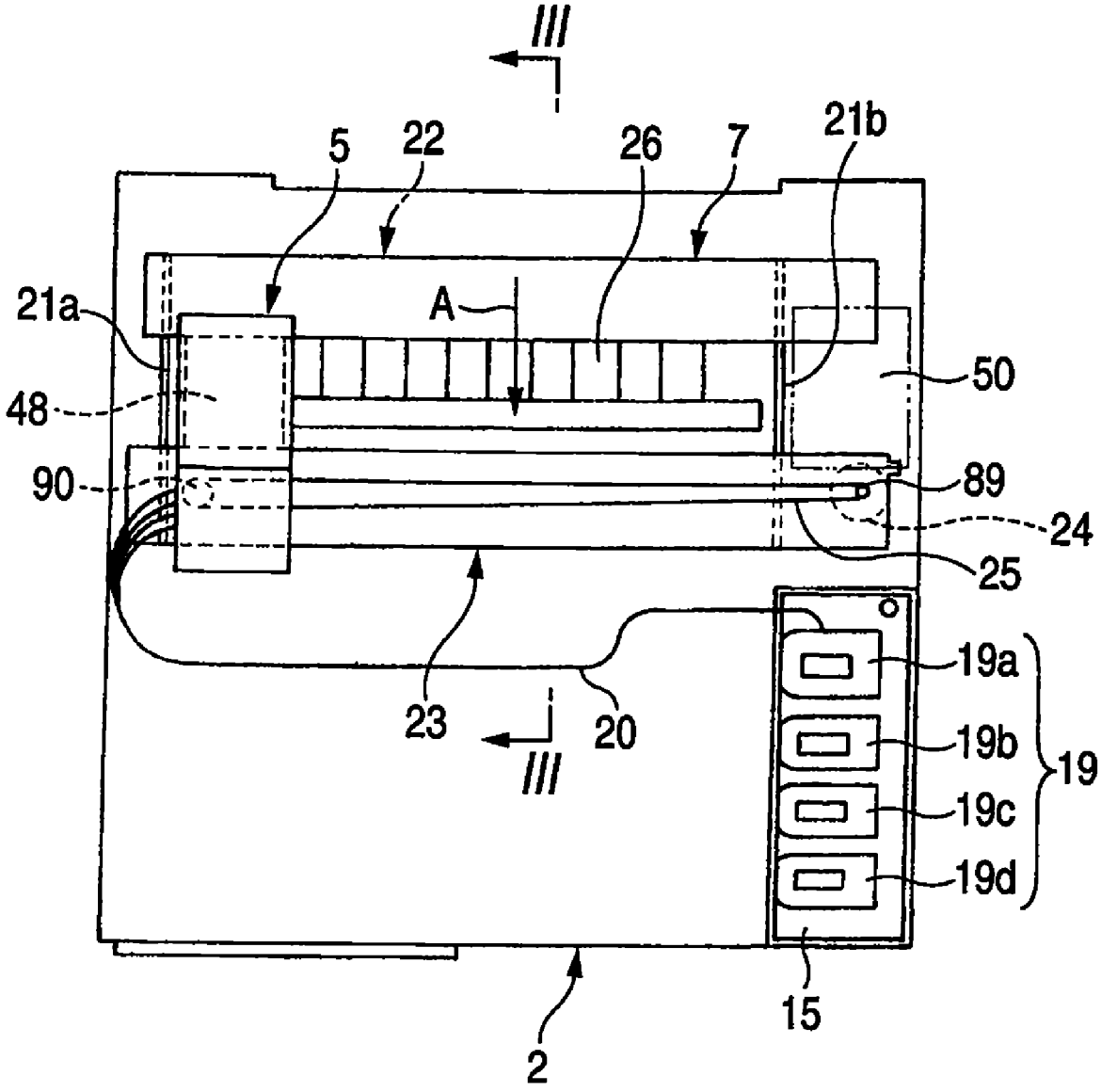
FIG. 2 is a top plan view of an image forming unit of the image forming device in a state where an image scanning unit is removed.

As shown in FIGS. 2 and 3, the image forming unit 7 includes: a first guide member 22; a second guide member 23; the carriage 5; a timing belt 25; a CR (carriage) motor 25; and a platen 26.

The first guide member 22 and the second guide member 23 are supported by a pair of left and right side plates 21*a* and 21*b* of a frame-shaped main frame 21 having an opened upper face and a transversely elongated plate shape extending in the primary scanning direction. The carriage 5 is slidably supported (or mounted) across the first and second guide members 22 and 23 so as to reciprocate back and forth.

The timing belt 25 serves as an endless belt wound around and arranged between pulleys 89 and 90 above and in parallel with the upper face of the second guide member 23. The timing belt 25 reciprocates the carriage 5 carrying the print head 4. The CR motor drives the timing belt 25. The CR motor is exemplified by a DC motor but may be other motor such as a stepping motor. The platen 26 supports the sheet P being conveyed on the lower side of the print head 4.

The image forming unit 7 also includes other components such as a tape scale (although not shown) that serves as a part of an optical type linear encoder arranged to extend along the primary scanning direction for detecting the position of the carriage 5 in the primary scanning direction and a moving velocity in the primary scanning direction.

The first guide member 22 is arranged on the upstream side in the sheet conveying direction for conveying the sheet P (in the direction shown by an arrow A in FIG. 2), and the second guide member 23 is arranged on the downstream side in the sheet conveying direction.

A pair of registration rollers 27 is arranged on the upstream side of the sheet conveying direction with respect to the platen 26. The registration rollers 27 convey the sheet P into the gap between the nozzle face or the lower face of the print head 4 and the platen 26.

A spur 28*b* and a discharge roller 28*a* are arranged on the downstream side with respect to the platen 26. The spur 28*b* contacts with the upper face of the sheet P, and the discharge roller 28*a* conveys the sheet P from below so as to covey the printed sheet P to the sheet discharging section 10.

As shown in FIG. 2, an ink receiving unit 48 and a maintenance unit 50 are arranged in areas outside an area where the sheet P is conveyed. The ink receiving unit 48 is arranged at one side (at a side closer to the left side plate 21*a* in the present example), and the maintenance unit 50 is arranged on the other side (at a side closer to the right side plate 21*b* in the present example)

The print head 4 performs discharging the ink periodically during the print operation at a flushing position set in the ink receiving portion 48 so as to prevent the nozzles from being clogged by the ink, and receives the ink at the ink receiving portion 48.

The position where the maintenance unit 50 is provided is defined as a standby position for the carriage 5. The maintenance unit 50 performs a recovery operation to suck the ink selectively for each color and to remove air bubbles in the not-shown buffer tank provided in the print head 4. The maintenance unit 50 is provided with a wiper, although not shown, for cleaning the nozzle face of the print head 4 when the carriage 5 is moved from the standby position toward a direction where the print operation is performed.

A configuration of a lower part (which serves as the cassette accommodation portion) of the housing 2, and a structure for accommodating the sheet feeding cassette 3 in the cassette accommodation portion, will be described hereinbelow.

At the right side of the housing 2, there is formed a partitioned portion 2*c*, in which the ink storage section 15 is provided. At the left side portion of the housing 2, there is formed a partitioned portion 2*d*, in which a control board and a power transmission unit are provided.

On the front side of the housing 2, a first support portion 29 formed in a thin plate shape is integrated with a bottom part of the housing 2 so as to connect the left and right partitioned portions 2*d* and 2*c*. At a suitably higher position therefrom, the left and right partitioned portions 2*d* and 2*c* are connected by a ceiling plate 2*e* so that a space, as defined by the left and right partitioned portions 2*d* and 2*c*, the first support portion 29 and the ceiling plate 2*e*, is opened as the insertion slot 2*a*.

At the bottom portion of the housing 2 toward the backside in the insertion direction of the sheet feeding cassette 3, a second support portion 30 formed in a thin flat plate shape is integrally provided so as to connect the left and right partitioned portions 2*d* and 2*c* with a rear vertical plate 2*b*. An opening 31 is formed between the first support portion 29 and the second support portion 30 (See FIGS. 4, 5, 7 and 10).

The cassette accommodation portion is a space defined above the first support portion 29 and the second support portion 30 and by the left and right partitioned portions 2*d* and 2*c*, the insertion slot 2*a* and the rear vertical plate 2*b*. The bottom face (the bottom plate 3*a*) of the sheet feeding cassette 3 is broadly exposed downward at the opening 31 when the sheet feeding cassette 3 is accommodated in the cassette accommodation portion.

Figure 10:
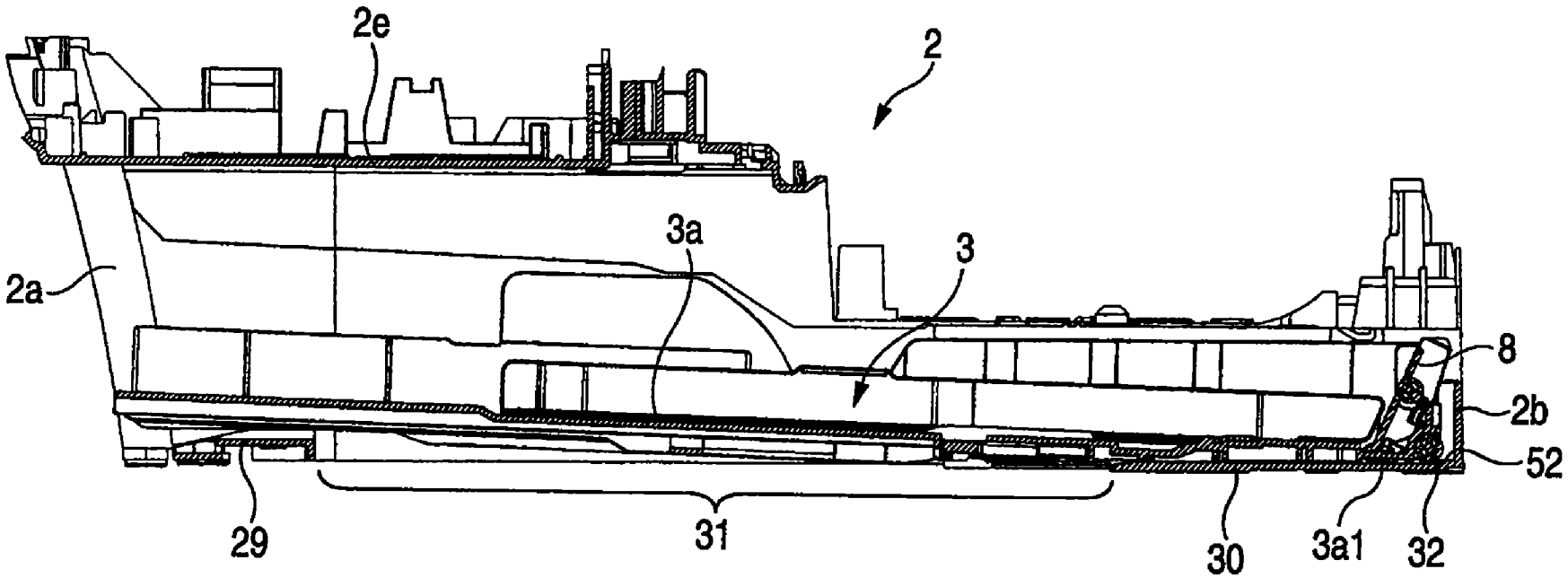
FIG. 10 is a sectional side view of the sheet feeding cassette and the housing in a state where the sheet feeding cassette is housed in the housing.

When the sheet feeding cassette 3 is inserted or extracted, the bottom face (the bottom plate 3*a*) is supported on the first and second support portions 29 and 30 (as shown in FIG. 10). The bottom face (the bottom plate 3*a*) of the sheet feeding cassette 3 is configured to have a vertical clearance from an installation surface, such as a desktop, on which the image forming device 1 is installed and which the opening 31 faces (see FIG. 10), while the sheet feeding cassette 3 is accommodated in the cassette accommodation portion.

Side guide portions 30*a* are provided in the bottom part of the housing 2, at both side edges of the cassette accommodation portion, in the widthwise direction of the cassette accommodation portion. In the present example, the side guide portions 30*a* are provided between the partitioned portions 2*d* and 2*c* and the opening 31. The side guide portions 30*a* guide the side edges 3*c* formed at both side edges of the bottom face in the widthwise direction of the sheet feeding cassette 3. The side guide portions 30*a* are connected on the outer sides of the opening 31 to the second support portion 30, and formed to extend in the direction to come close to the first support portion 29 (see FIG. 7).

On a backside of the cassette accommodation portion of the housing 2, where a rear end of the sheet feeding cassette 3 is inserted, there is disposed a position retaining mechanism that retains the sheet feeding cassette 3 in the cassette accommodation portion. The position retaining mechanism includes: positioning portions 54 that position the sheet feeding cassette 3; and engagement hooks 53 that engage with clicking mechanisms 33, which allow a user to recognize a completion of accommodation of the sheet feeding cassette 3 into the cassette accommodation portion.

Figure 6A:
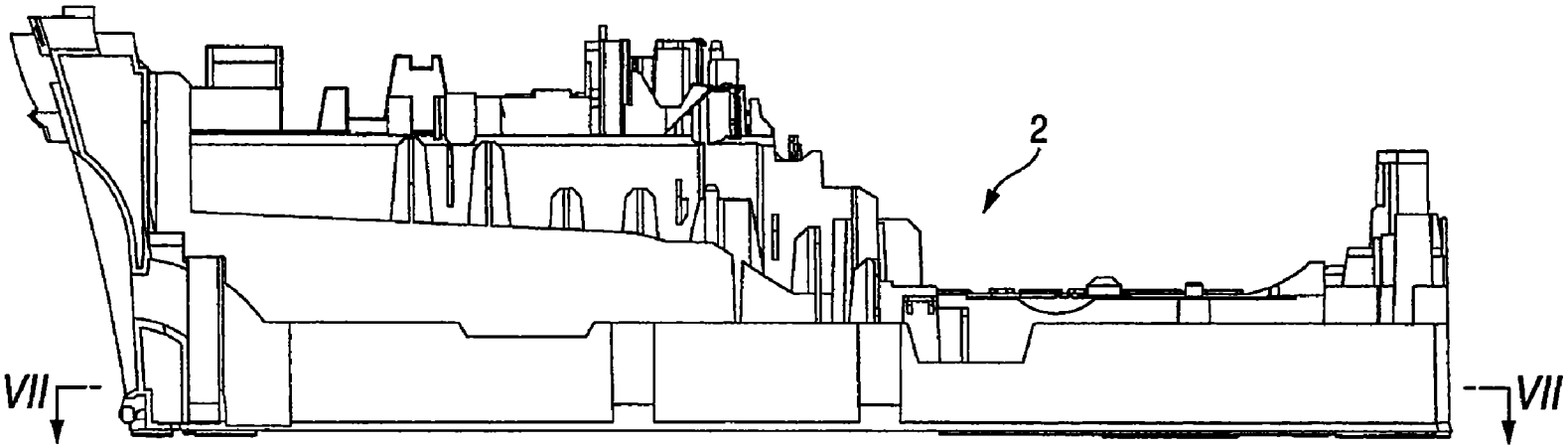
FIG. 6A is a side view as viewed from line VIa-VIa shown in FIG. 4.
Figure 6B:
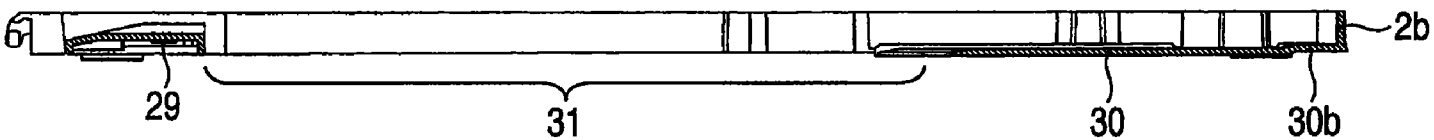
FIG. 6B is a sectional view taken along line VIb-VIb shown in FIG. 7.
Figure 7:
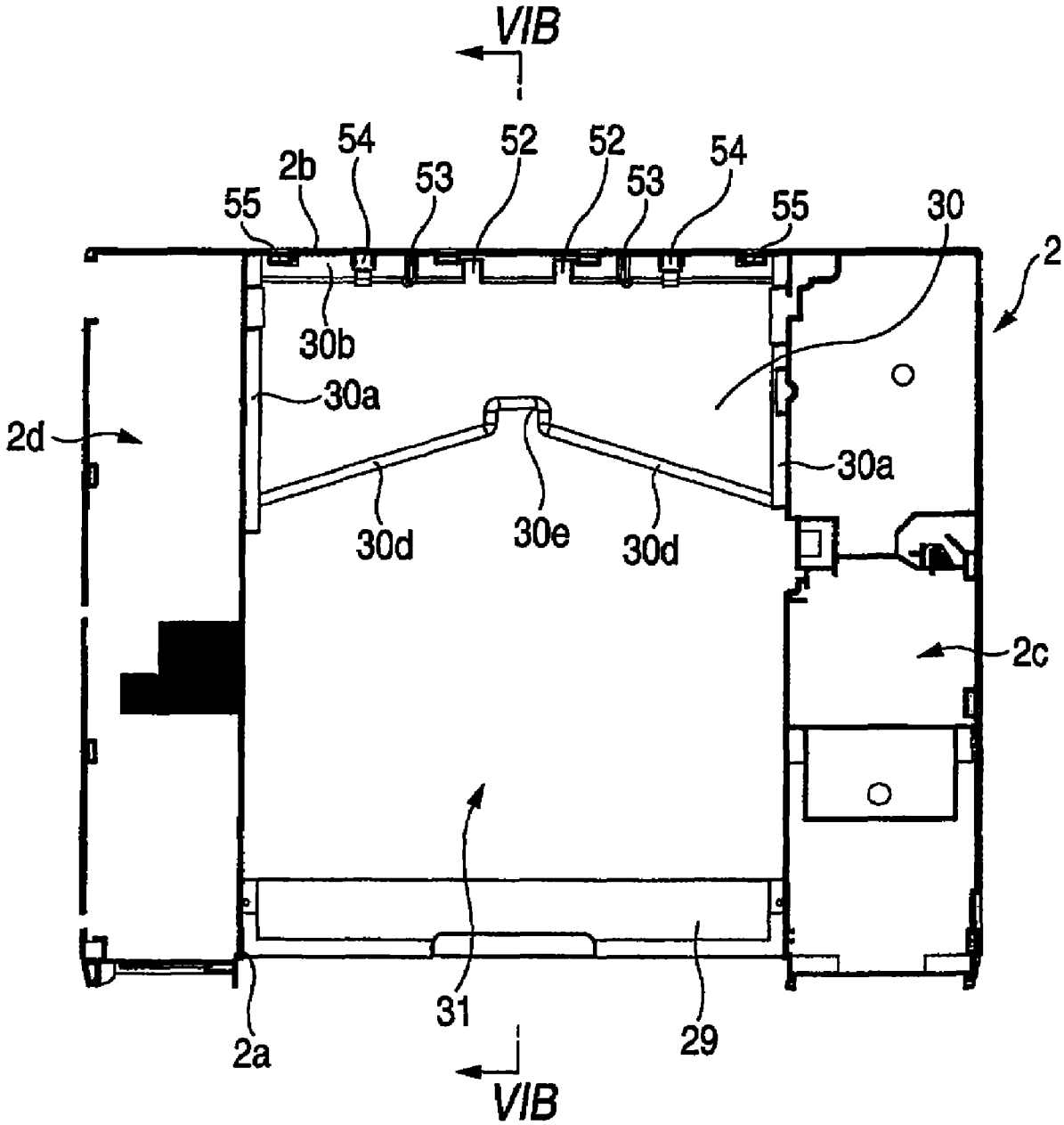
FIG. 7 is a sectional view taken along VII-VII shown in FIG. 6A.
Figure 11:
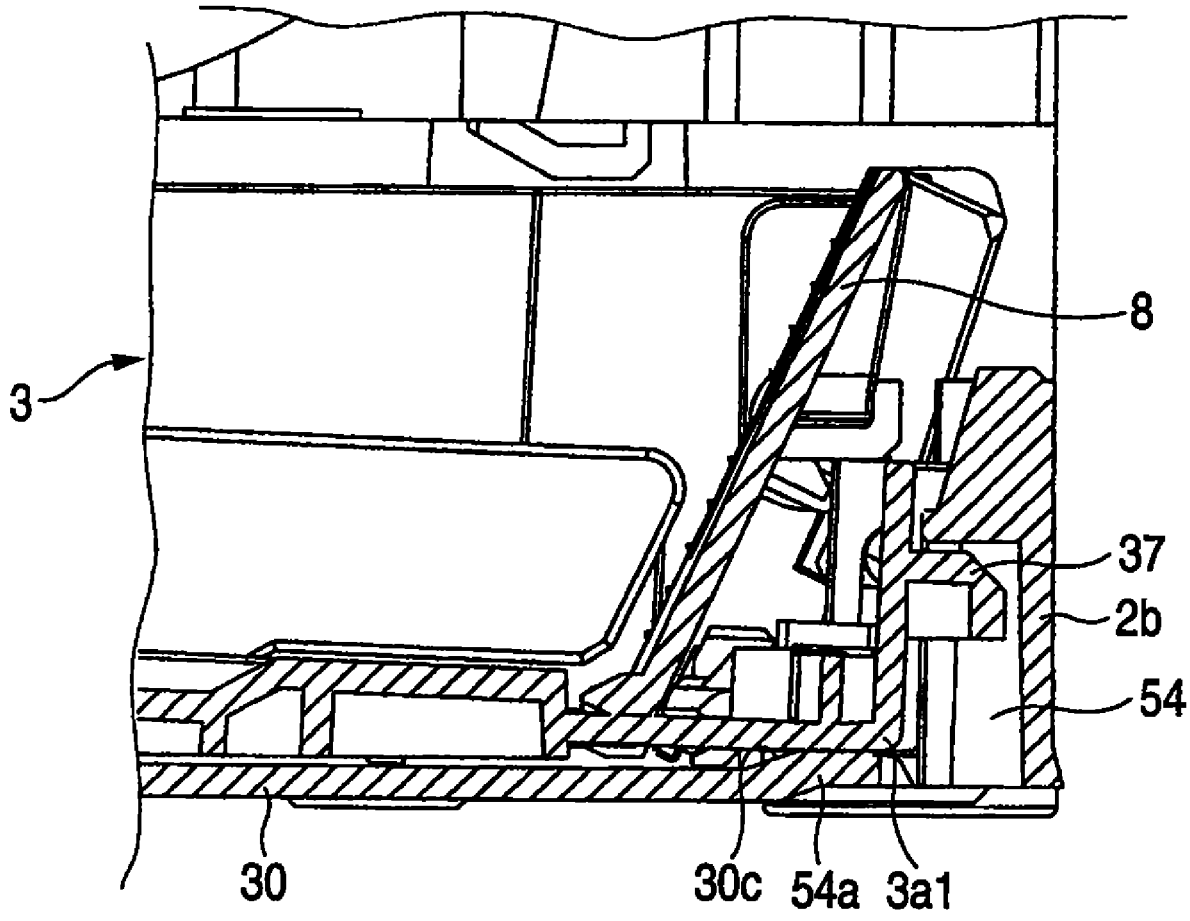
FIG. 11 is a sectional side view, being partially cut-away and enlarged, of a positioning portion.

In the present example, a stepped portion 30*b* that is slightly higher than the front side of the second support portion 30 is integrally formed with a portion where the second support portion 30 and the rear vertical plate 2*b* of the housing 2 are connected (see FIGS. 6, 7 and 11). A pair of releasing grooves 52 are formed on the stepped portion 30*b* at positions symmetrical and close to a central portion of the cassette accommodation portion in the widthwise direction (or in the primary scanning direction). The releasing grooves 52 are formed to have a bottom face that is in plane with an upper surface of the second support portion 30, and are formed to open toward the insertion direction of the sheet feeding cassette 3 (as shown in FIG. 4).

The engagement hooks (engagement protrusions) 53 are disposed on the stepped portion 30*b* at positions symmetrical and suitably separated in the widthwise direction of the cassette accommodation portion to sandwich the releasing grooves 52 therebetween. The engagement hooks 53 provide a clicking sense, as described later, and are protruded toward the front side to face the insertion direction of the sheet feeding cassette 3 (see FIGS. 4, 5, 7, and 14).

The positioning portions 54 are disposed on the stepped portion 30*b* at positions symmetrical and suitably separated in the widthwise direction of the cassette accommodation portion to sandwich the engagement hooks 53 therebetween. The positioning portions 54 position the sheet feeding cassette 3, mainly in the widthwise direction, with respect to the cassette accommodation portion when the sheet feeding cassette 3 is completely accommodated in the cassette accommodation portion.

The positioning portions 54 are gate-shaped frame members that are opened toward the front side to face the insertion direction of the sheet feeding cassette 3. The positioning portions 54 receive engagement projections 37 that are formed in the sheet feeding cassette 3 for positioning the sheet feeding cassette 3 as described later. Placing portions 54*a* are slightly higher than the stepped portions 30*b*. Placing portions 54*a* are formed near the positioning portions 54 at a side near to the opening 31. An upper surface of the second support portion 30 and the placing portions 54*a* are connected by sloped faces 30*c* that are formed respectively therebetween (as shown in FIG. 11). An internal width of each of the positioning portions 54 is set so as to prevent the sheet feeding cassette 3 from rattling in the widthwise direction when the engagement projections 37 are fitted therein.

In addition, abutting projections 55 are formed on the stepped portion 30*b* at positions symmetrical and suitably separated in the widthwise direction of the cassette accommodation portion to sandwich the positioning portions 54. When the sheet feeding cassette 3 is completely accommodated in the cassette accommodation portion, the abutting projections 55 abut against abutting portions 40 that are formed at a rear-end vertical plate 3*b* of the sheet feeding cassette 3 to sandwich the engagement projections 37. Thereby the sheet feeding cassette 3 is positioned with respect to the sheet accommodation portion in the insertion direction of the sheet feeding cassette 3.

Figure 9:
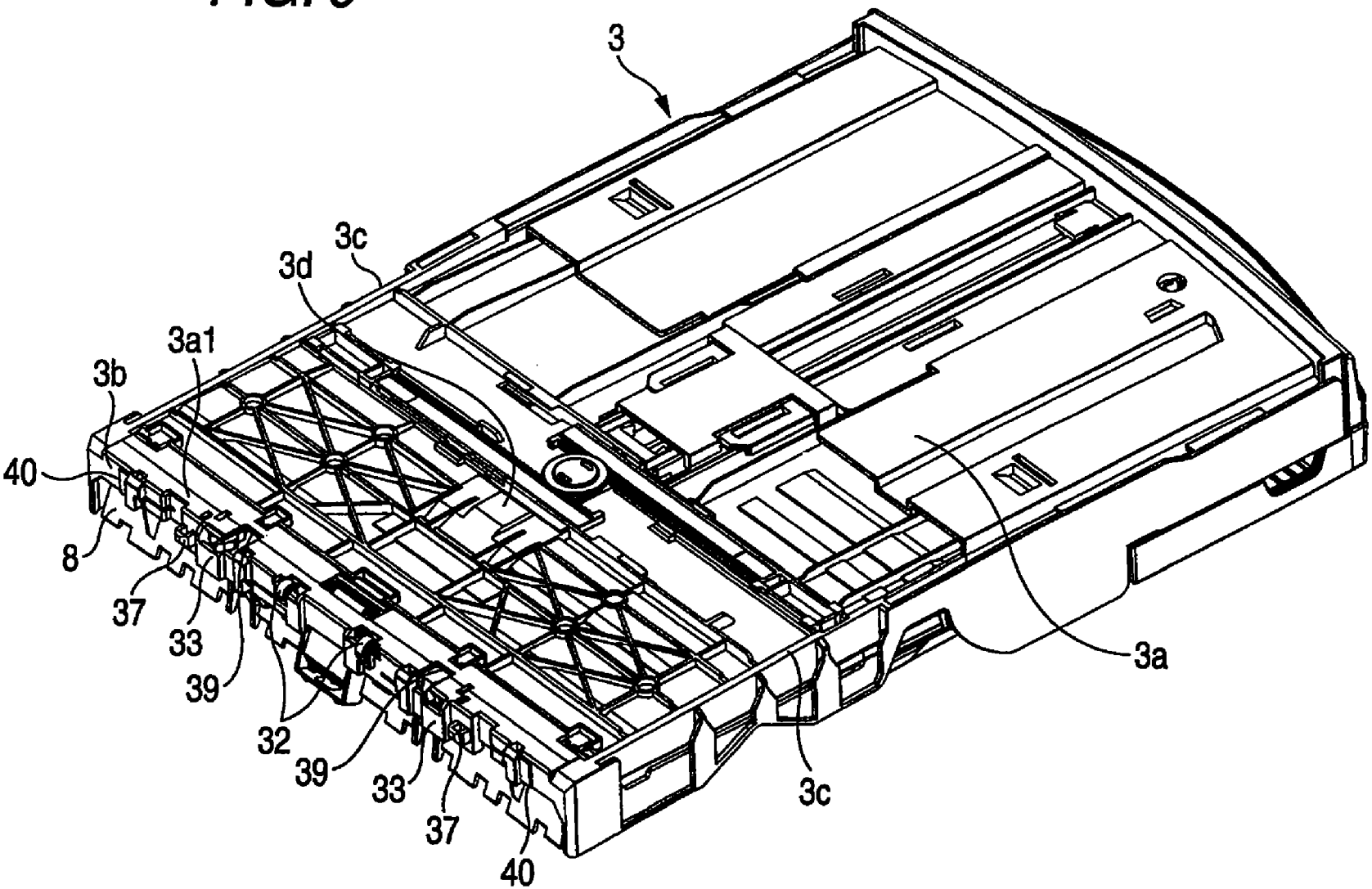
FIG. 9 is a perspective view taken from the back of the sheet feeding cassette.

The configuration of the rear end portion of the sheet feeding cassette 3 will now be described. A pair of rollers 32 are provided at positions near a corner portion where a rear-end bottom plate 3*a*1 and a rear-end vertical plate 3*b* of the sheet feeding cassette 3 are connected with each other, the positions being near to the central portion of the sheet feeding cassette 3 in the widthwise direction (the primary scanning direction). The rollers 32 are disposed at such positions that a height from lower ends of the rollers 32 to the lower face of the rear-end bottom plate 3*a*1 is about 1 to 2 mm. The lower ends of the rollers 32 are protruded slightly downward from the lower face of the rear-end bottom plate 3*a*1 (see FIGS. 3, 8 and 9).

The rollers 32 (paired as left and right rollers) are disposed at positions so as to be introduced into the releasing grooves 52 of the housing 2.

The engagement projections 37, which corresponds to the respective positioning portions 54, are projected backward from the rear-end vertical plate 3*b* (or projected toward the downstream side of the insertion direction of the sheet feeding cassette 3) on the left and right sides to sandwich the paired rollers 32. Accordingly, the sheet feeding cassette 3 is positioned at least in the widthwise direction when the sheet feeding cassette 3 is completely accommodated in the cassette accommodation portion of the housing 2.

The clicking mechanisms 33 are provided at positions near to the corner portion to sandwich the rollers 32. The clicking mechanisms 33 (see FIGS. 8 and 9) correspond to the respective engagement hooks 53.

Figure 13:
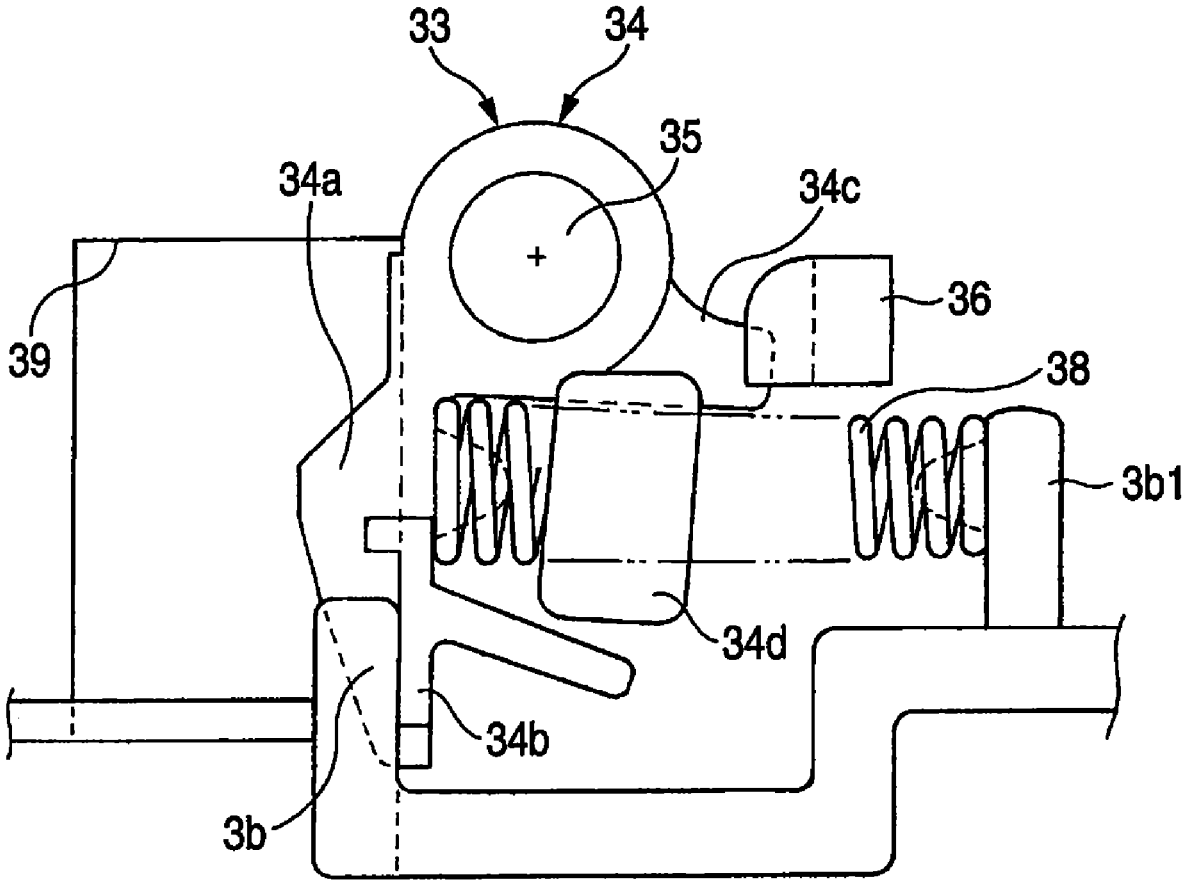
FIG. 13 is an enlarged top plan view of a clicking mechanism.

As shown in FIG. 13, each of the clicking mechanisms 33 are provided with a clicking member 34, which is formed by injection-molding a synthetic resin material, is provided to be horizontally rotatable around a vertical pin 35 on the upper face of the bottom plate 3*a*.

The clicking member 34 is monolithically provided with: a retaining portion 34*a* having a triangular shape in a top plan view and retaining a side face of the engagement hook 53; and a stopper portion 34*b* that abuts against the rear-end vertical plate 3*b* of the sheet feeding cassette 3, when pushed by a coil spring 38, thereby to regulate the rotational position (see FIG. 13).

A stopper portion 34*c*, which horizontally projects from the clicking member 34, abuts upward against a stopper portion 36 formed on the upper face of the rear-end bottom plate 3*a*1. Accordingly, the clicking member 34 is prevented from being pulled out upward from the vertical pin 35. The coil spring 38 is interposed between a tongue portion 34*d* protruding horizontally from the upper face of the clicking member 34 and the rear-end bottom plate 3*a*1, so that both ends of the coil spring 38 urge a support projection member 3*b*1 of the rear-end vertical plate 3*b* and the back face of the retaining portion 34*a*.

Figure 14:
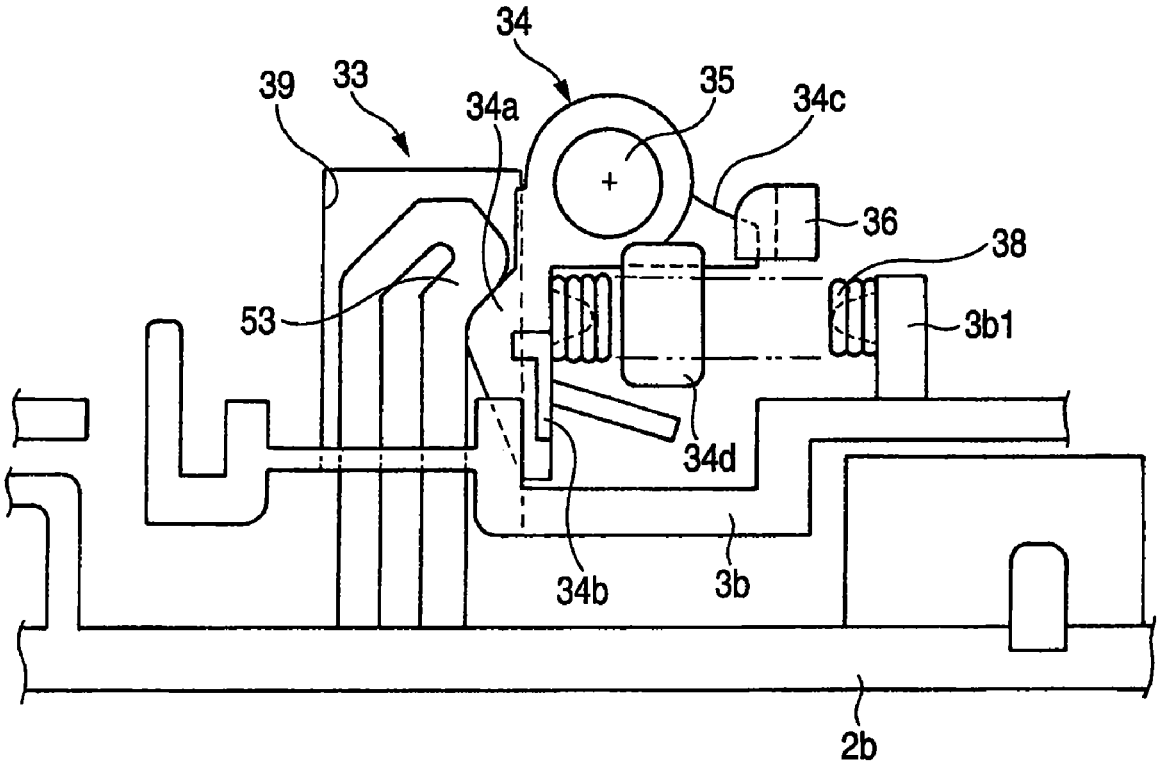
FIG. 14 is an enlarged top plan view of the clicking mechanism in a state where engaging pawls are fitted in the clicking mechanism.

When the sheet feeding cassette 3 is completely accommodated in the cassette accommodation portion of the housing 2, the engagement hooks 53 enter holes 39 formed in the rear-end bottom plate 3*a*1 of the sheet feeding cassette 3 (see FIGS. 13 and 14).

With the configuration thus described, the image forming device 1 is placed on the installation surface (although not shown), such as a desktop of a working table, and the sheet feeding cassette 3 is inserted from the insertion slot 2*a* of the housing 2. At this first step, the backside (or the downstream side in the insertion direction) of the sheet feeding cassette 3 slides on the first support portion 29. At this time, the paired left and right rollers 32, as disposed on the lower face of the rear-end bottom plate 3*a*1 in the sheet feeding cassette 3, roll on the surface of the first support portion 29.

When the rollers 32 roll over the first support portion 29 and reach the opening 31, the rollers 32 roll on the installation surface. As a result, the rear-end bottom plate 3*a*1 and the bottom plate 3*a* on the more front side (or the upstream side in the insertion direction or the side where provided with a drawing handle) is prevented from scraping or scratching the installation surface, while the sheet feeding cassette 3 can be lightly inserted. At this time, the bottom plate 3*a* on the front side of the sheet feeding cassette 3 is supported by the first support portion 29.

As the sheet feeding cassette 3 is further inserted toward the backside, the rollers 32 reach a front edge 30*d* of the second support portion 30. Then, the rollers 32 roll over the front edge 30*d* and on the surface of the second support portion 30. As a result, a small vertical clearance is formed between the lower face of the rear-end bottom plate 3*a*1 of the sheet feeding cassette 3 and the surface of the second support portion 30. As a result, in the opening 31 formed between the first support portion 29 and the second support portion 30, a vertical clearance larger than the thickness of the second support portion 30 is formed between the lower face of the bottom plate 3*a* on the upstream side in the insertion direction (i.e., the side provided with the drawing handle) of the sheet feeding cassette 3 and the installation surface.

Figure 12:
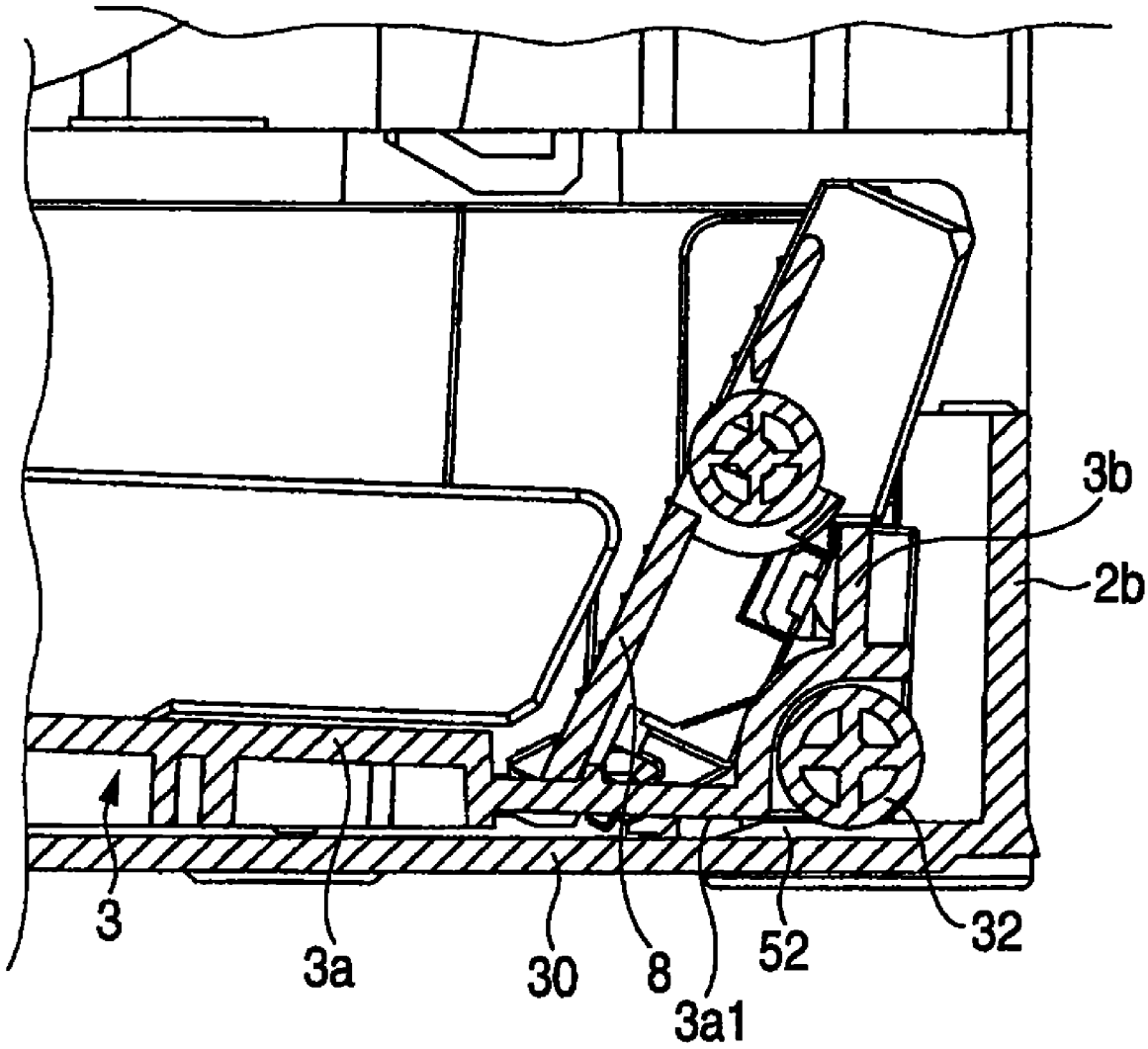
FIG. 12 is a sectional side view, being partially cut-away and enlarged, of the positioning portion in a state where rollers are fitted in releasing grooves.

When the sheet feeding cassette 3 is further inserted, the rear-end vertical plate 3*b* of the sheet feeding cassette 3 comes closer to the rear vertical plate 2*b* of the housing 2. At this time, the rear-end bottom plate 3*a*1 slides oh the placing portions 54*a* of the positioning portions 54 via the sloped faces 30*a* (see FIG. 11) so that the rollers 32 in the releasing grooves 52 are held in a floating state from the surface of the second support portion 30 (see FIG. 12). Then, the paired left and right engagement projections 37 of the sheet feeding cassette 3 are fitted in the paired left and right positioning portions 54 of the rear vertical plate 2*b* of the housing 2, so that the sheet feeding cassette 3 completely accommodated in the cassette accommodation portion of the housing 2 can be positioned at least in the widthwise direction.

When the sheet feeding cassette 3 is completely accommodated in the cassette accommodation portion, the paired left and right abutting portions 40 of the sheet feeding cassette 3 abut against the paired left and right positioning abutting portions 55 thereby to position the sheet feeding cassette 3 with respect the cassette accommodation portion in the cassette insertion direction.

While the engagement hooks 53 of the housing 2 are being inserted into the holes 39 formed in the rear-end vertical plate 3*b* of the sheet feeding cassette 3, the projecting portions of the retaining portions 34*a* of the clicking members 34 are horizontally retracted against the urging force of the coil spring 38 (as shown in FIG. 14). At this time, a user inserting the sheet feeding cassette 3 recognizes the clicking sense reliably as the response to an increase and decrease of a resisting force against the insertion of the sheet feeding cassette 3.

When the sheet feeding cassette 3 is to be extracted from the housing 2, the operations are reversed from the operations described above. When extracting the sheet feeding cassette 3, the rollers roll on the exposed installation surface at the opening 30 so that the bottom plate of the sheet feeding cassette 3 and the installation surface are prevented from being scraped or scratched with each other.

When the sheet feeding cassette 3 is thus completely accommodated in the cassette accommodation portion of the housing 2, the rear-end bottom plate 3*a*1 of the sheet feeding cassette 3 is supported by the paired left and right placing portions 54*a* in the second support portion 30. As a result, the front side of the lower face of the bottom plate 3*a* of the sheet feeding cassette 3 is supported by the first support portion 29, and the longitudinally intermediate portion of the lower face of the bottom plate 3*a* can be held in such a state as to be prevented from scraping the installation surface. The bottom portion of the housing 2 is formed with the opening 31 having a significantly large area, whereby a material to be used for forming the housing 2 is reduced.

In a case where the sheet feeding cassette 3 is used for a long time, and the bottom plate 3*a* is slightly deformed to bulge downward, the sheet feeding cassette 3 can be lightly inserted and extracted by the rollers 32 without scratching the installation surface exposed through the opening 31.

Figure 5:
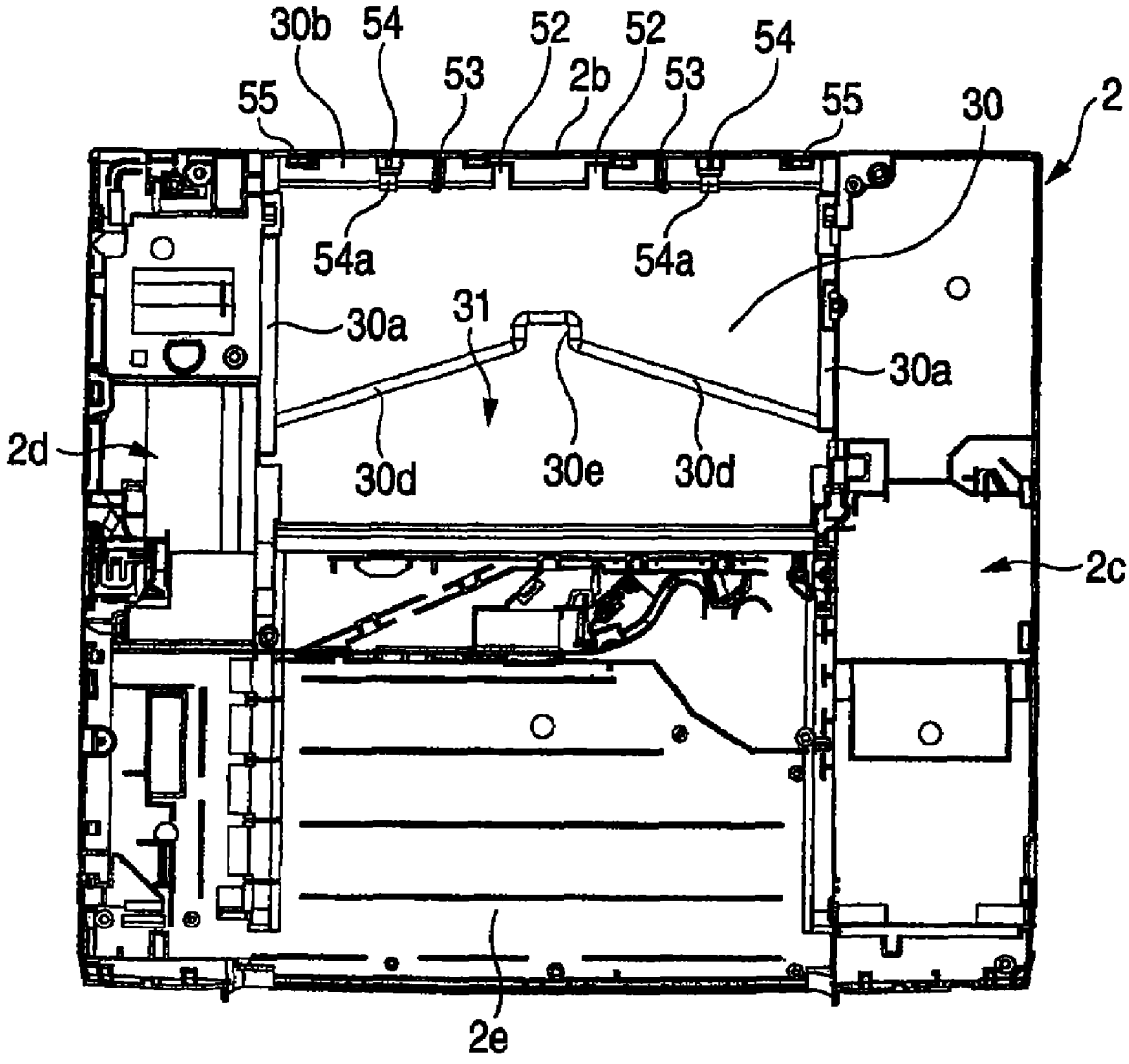
FIG. 5 is a top plan view of the housing.

In the present example described in the above, the front edge 30*d* (of the second support portion 30 (i.e., the edge bordering the opening 31) is not formed to be perpendicular to the insertion direction of the sheet feeding cassette 3 in the top plan view, but is formed to be slanted (as referred to FIG. 5 and FIG. 7). Accordingly, the rollers 32 easily ride on the upper face of the second support portion 30.

By providing a notched portion 30*e* having a C-shape in a top plan view and being formed at the center portion of the front edge 30*d* in the widthwise direction, a bottom portion 3*d* formed at a widthwise center portion of the bottom plate 3*a* of the sheet feeding cassette 3 is to be fitted in the notched portion 30*e*. Accordingly, the rattling of the sheet feeding cassette in the widthwise direction can be further reduced.

What is claimed is:

1. An image forming device comprising:

a housing; and a sheet feeding cassette that stores a stack of sheets, wherein the housing includes:

a cassette accommodation portion that is provided at a lower part of the housing to accommodate the sheet feeding cassette;

an insertion slot from which the sheet feeding cassette is detachably inserted into the cassette accommodation portion in an insertion direction that is substantially horizontal;

a first support portion that is formed on a bottom part of the housing on a side near to the insertion slot in the insertion direction to support a bottom face of the sheet feeding cassette;

a second support portion that is formed on the bottom part of the housing on a side remote from the insertion slot in the insertion direction to support the bottom face of the sheet feeding cassette; and an opening that is formed between the first support portion and the second support portion to expose the bottom face of the sheet feeding cassette, and wherein the sheet feeding cassette includes a roller that is disposed at the bottom face of the sheet feeding cassette, at a downstream side end of the sheet feeding cassette in the insertion direction.

2. The image forming device according to claim 1, wherein the housing includes side guide portions that are formed on the bottom part of the housing at both side edges of the cassette accommodation position, the side guide portions being configured to guide side edges that are formed at both side edges, in a direction perpendicular to the insertion direction, of the bottom face of the sheet feeding cassette, wherein the side guide portions are formed to be connected to the second support portion at positions outside the opening and to be extended in a direction toward the first support portion.

3. The image forming device according to claim 1, wherein in a state where the sheet feeding cassette is accommodated in the cassette accommodation portion, the bottom face of the sheet feeding cassette is supported by the first support portion and the second support portion to have a vertical clearance between the bottom face and an installation surface on which the housing is disposed.

4. The image forming device according to claim 1, wherein the housing further comprises a position retaining mechanism that retains the sheet feeding cassette in the cassette accommodation portion.

5. The image forming device according to claim 4, wherein the position retaining mechanism is provided on the bottom part of the housing on the side remote from the insertion slot in the insertion direction.

6. The image forming device according to claim 5, wherein the position retaining mechanism is provided on at least one of the second support portion and a vertical member that is adjacent to the second support portion.

7. The image forming device according to claim 4, wherein the position retaining mechanism includes a clicking mechanism that creates a clicking sense upon completion of insertion of the sheet feeding cassette when the sheet feeding cassette is accommodated in the cassette accommodation portion.

8. The image forming device according to claim 7, wherein the clicking mechanism includes:

a first engagement member that is provided at the downstream side end of the sheet feeding cassette in the insertion direction; and a second engagement member that is provided at an end of the bottom part of the housing on the side remote from the insertion slot in the insertion direction, the second engagement member being configured to engage with the first engagement member when the sheet feeding cassette is accommodated in the cassette accommodation portion.

9. The image forming device according to claim 4, wherein the position retaining mechanism includes a positioning member that positions the sheet feeding cassette in the cassette accommodation portion.

10. The image forming device according to claim 9, wherein the positioning member includes:

a first positioning member that is provided at the downstream side end of the sheet feeding cassette in the insertion direction; and a second positioning member that is provided at an end of the bottom part of the housing on the side remote from the insertion slot in the insertion direction, the second positioning member being configured to fit with the second engagement member when the sheet feeding cassette is accommodated in the cassette accommodation portion.

11. The image forming device according to claim 9, wherein the positioning member positions the sheet feeding cassette such that the roller floats above the second support portion and a part of the bottom face of the sheet feeding cassette is supported by the bottom part of the housing.

12. The image forming device according to claim 1, wherein the second support portion has an edge bordering the opening, the edge being slanted with respect to the insertion direction of the sheet feeding cassette.

* * * * *